US010246971B2

(12) United States Patent
Doane et al.

(10) Patent No.: US 10,246,971 B2
(45) Date of Patent: Apr. 2, 2019

(54) FLOW ACTIVATED VALVE

(71) Applicant: BAKER HUGHES, A GE COMPANY, LLC, Houston, TX (US)

(72) Inventors: James C. Doane, Friendswood, TX (US); Ronnie D. Russell, Cypress, TX (US); Barbara A. Pratt, Pearland, TX (US); Erwin D. Hernaez, Houston, TX (US); Juan C. Flores Perez, The Woodlands, TX (US); Elias Pena, Katy, TX (US); Tristan R. Wise, Spring, TX (US); Steven R. Merrill, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 362 days.

(21) Appl. No.: 14/996,956

(22) Filed: Jan. 15, 2016

(65) Prior Publication Data

US 2017/0089175 A1 Mar. 30, 2017

Related U.S. Application Data

(60) Provisional application No. 62/232,179, filed on Sep. 24, 2015.

(51) Int. Cl.

| | |
|---|---|
| ***E21B 34/10*** | (2006.01) |
| ***E21B 43/26*** | (2006.01) |
| ***E21B 23/00*** | (2006.01) |
| *E21B 34/00* | (2006.01) |

(52) U.S. Cl.

CPC ..... *E21B 34/10* (2013.01); *E21B 23/006* (2013.01); *E21B 34/102* (2013.01); *E21B 34/103* (2013.01); *E21B 43/26* (2013.01); *E21B 2034/002* (2013.01)

(58) Field of Classification Search

CPC ..... E21C 34/10–34/14
USPC ..... 166/317, 319
See application file for complete search history.

(56) References Cited

U.S. PATENT DOCUMENTS

| | | | | |
|---|---|---|---|---|
| 2,442,642 | A * | 6/1948 | Eckel | F16K 15/042 137/512 |
| 5,564,471 | A | 10/1996 | Wilder et al. | |
| 6,220,360 | B1 | 4/2001 | Connell et al. | |
| 6,394,180 | B1 | 5/2002 | Berscheidt et al. | |
| 6,959,766 | B2 * | 11/2005 | Connell | E21B 23/04 166/318 |
| 7,740,079 | B2 | 6/2010 | Clayton et al. | |
| 8,657,039 | B2 * | 2/2014 | Radford | E21B 10/322 166/318 |

(Continued)

FOREIGN PATENT DOCUMENTS

WO 0015943 A1 3/2000

*Primary Examiner* — Janine M Kreck
(74) *Attorney, Agent, or Firm* — Shawn Hunter

(57) ABSTRACT

A valve assembly for a plug to close off a zone in the well for further treatment above the plug features a valve member initially pinned in an open position where flow up to a predetermined level can move through without dislodging the valve plug to move to its associated seat. If the perforating gun misfires a replacement gun can be run in with flow as the plug is still retained in the position for flow through the plug. On the other hand flow around the plug above a predetermined level will shear retainers for the plug and let the plug land on its seat closing flow in a downhole direction for treatment.

19 Claims, 6 Drawing Sheets

(56) References Cited

U.S. PATENT DOCUMENTS

| | | | | |
|---|---|---|---|---|
| 2009/0050332 | A1 | 2/2009 | Cowie et al. | |
| 2010/0132954 | A1 | 6/2010 | Telfer | |
| 2013/0168099 | A1* | 7/2013 | Themig | E21B 34/103 166/308.1 |
| 2013/0277044 | A1 | 10/2013 | King et al. | |
| 2014/0060813 | A1 | 3/2014 | Naedler et al. | |
| 2014/0311747 | A1 | 10/2014 | Aitken et al. | |

* cited by examiner

FLOW ACTIVATED VALVE

CROSS REFERENCE TO RELATED APPLICATION

This application is claims priority from U.S. Provisional Patent Application Ser. No. 62/232,179, for "Flow Activated Valve", filed on Sep. 24, 2015, the disclosure of which is incorporated herein by reference.

FIELD OF THE INVENTION

The field of the invention is flow sensitive valves inserted as a component of frac plugs or seat assemblies and more particularly valves used in plug and perforate equivalent systems where the valve stays open at low flow rates and is selectively closed to flow in a downhole direction from surface provided flow.

BACKGROUND OF THE INVENTION

There are many forms of fracturing being used and one of those methods is known as plug and perforate. In this method a zone that has already been treated is isolated with a plug and a perforating gun is released from the plug and repositioned for perforating. With the zone previously treated now isolated with the plug the newly perforated zone can be fractured through the newly made perforations above the plug.

The plug designs in the past have involved dropping or pumping a ball onto a seat from surface after the guns are out of the hole, in one form of plug valve. The problem with this design is that it takes time and water to get the ball pumped to the seat.

Other valve designs for frac plugs have been proposed to avoid sending down a ball to land in a seat. These designs involve a caged ball that lifts off a seat when the gun is advanced with the cage retaining the ball. Flow in the downhole direction seats the ball on the seat to prevent flow. This means if the gun fails to fire there is no way to use flow to deliver a replacement gun as any such flow in the downhole direction seats the ball on the seat.

Yet other types of spring biased check valves have been suggested but they too will shut with flow in the downhole direction leaving the same problem of how to run in a replacement gun if the original gun fails to fire.

U.S. Pat. No. 5,564,471 illustrates a fuel delivery breakaway valve that closes off flow in the hose that separates with a car that drives off and blocks flow out of the hose remnant going back out as well as blocking flow out of the portion still attached to the pump. The opposed check valves are actuated with physical separation of the housing. Automobile fuel nozzles also have a valve member that is resettable that is actuated by backpressure from the tank being filled to avoid overfilling the gas tanks while then resetting to allow pumping additional fuel.

U.S. Pat. No. 6,394,180 shows a ball sitting on a spring with a covering cage to retain the ball to a frack plug. On increase in flow the ball compresses the spring to land on the seat until the flow is reduced and the spring can then raise the ball off the seat to reopen the passage. The ball is not retained in the uphole direction until it hits the surrounding cage. This design has the potential problem of the ball jamming around the spring rather than seating off on the seat for a clean seal. Other problems include; 1. Springs are made of hardened steel and aren't easily millable. Quick mill-out time is essential. 2. The force on the ball due to flow will change as it moves in the passage due to compressing the spring. This adds variability to the predetermined flow rate to close the valve.

What is needed and addressed by the present invention is a valve for a plug in a plug and perforate context that is disposed in the plug and has a selectively secured valve member that allows bypass flow and remains in the open position if the gun fails to fire so that a replacement gun can be run in with flow through the open valve. The plug member is selectively released with raising the flow rate through the plug to release the valve member to land on its seat to allow subsequent fracturing or other treatments such as stimulation or acidizing, for example. A backup seat is provided for dropping an object if for any reason the plug member fails to release and move to its seat. These and other aspects of the present invention will be more readily apparent from a review of the description of the preferred embodiment and the associated Figure while recognizing that the full scope of the invention is to be determined by the appended claims.

SUMMARY OF THE INVENTION

A valve assembly for a plug to close off a zone in the well for further treatment above the plug features a valve member initially pinned in an open position where flow up to a predetermined level can move through without dislodging the valve plug to move to its associated seat. If the perforating gun misfires a replacement gun can be run in with flow as the plug is still retained in the position for flow through the plug. On the other hand flow around the plug above a predetermined level will shear retainers for the plug and let the plug land on its seat closing flow in a downhole direction for treatment.

DETAILED DESCRIPTION OF THE PREFERRED EMBODIMENT

Figure 1:
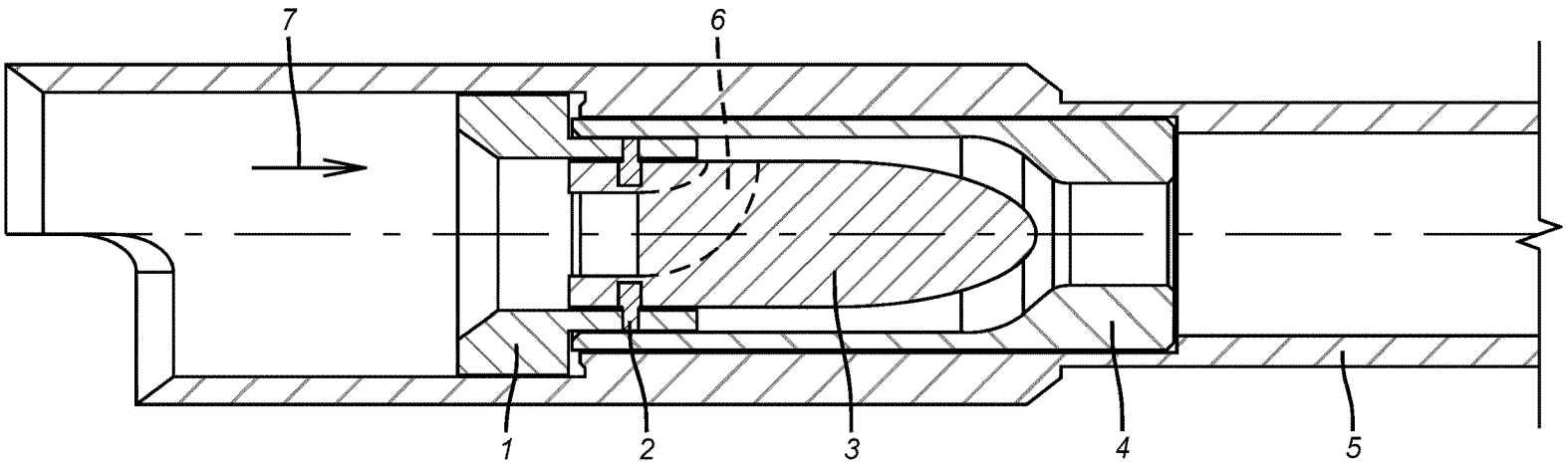
FIG. 1 shows the valve member in the open position when running in while retained by one or more shear pins.

Referring to FIG. 1 the valve body 5 retains a primary seat 4 for the plug member 3 that has a conforming shape at its leading end to the seat 4. One or more shear pins 2 are supported from the backup seat 1 to hold the plug member 3 in the position shown. A bypass passage 6 allows flow in the direction of arrow 7 when the pins 2 have not sheared. Nothing moves below a predetermined flow rate that puts less force on the plug 3 than the capacity of the shear pins 2. Those skilled in the art will realize that what is not illustrated is the plug that is initially set that has a sealing element ands slips. Typically this plug with the illustrated valve assembly is delivered with a perforating gun that supports the plug. The perforating gun is also not shown. The setting of the plug releases the gun from the plug so that the gun can be placed where needed and fired. Also those skilled in the art will realize that the valve can be incorporated in ball seat assemblies that are installed in pre-drilled baffles or seats in the casing and act and perform equivalently to a plug and perforate operation.

If the gun fails to fire the position of the components in FIG. 1 is unchanged. This means that passage 6 remains open to allow a subsequent run with a replacement gun to be accomplished with flow through the open passage 6.

If the gun does fire then one possibility is that the concussion from the firing of the gun will create a sufficient force to shear the pins 2 to allow the plug member 3 to advance and seal against the primary seat 4. Another way to shear the pins 2 is to simply increase the flow rate in the direction of the arrow 7 until enough force is applied to pins 2 to shear them and get the same result. The flow increase can be at the same time the gun is fired but is preferably later because it is necessary to know that the gun has fired before shearing the pins 2. As previously stated the firing of the gun may not shear the pins 2. There may be a long distance between the gun and the plug member 3 in some applications so that the mere firing of the gun will not shear the pins 2.

If for any reason the pins 2 do not release the plug 3 then a ball not shown can be landed on the secondary seat 1 to close off the plug to allow treatment above in the known manner.

While the retaining of the plug 3 can be done with one or more shear pins other temporary retaining devices that can selectively release are also contemplated such as shear rings, Belleville washer stacks or snap rings to name a few options. The bypass flow through passage 6 can be around the outside of the plug 3 or through the plug 3. Typically after the pins 2 are sheared the pressure that sheared them is continually applied to keep the plug 3 against the seat 4. Seat 1 is used to fixate seat 4 in body or mandrel 5 by supporting the lower end of the seat 4 on an internal shoulder in the valve body 5. The treatment under pressure against the plug 3 seated on seat 4 can vary to include such events as fracturing, acidizing, conditioning or other pressure dependent procedures needed for completion. In this sense reference to treatment in this application is intended to incorporate all such pressure dependent procedures in a completion process.

As an alternative to the valve member 3 landing on seat 4 to close flow in one direction the closing off of flow can be done indirectly using movement of the valve member 3 that in turn allows a flapper to fall closed blocking flow in a downhole direction. In the run in position the fixated valve member abuts the open flapper and movement of the valve member 3 downhole frees the flapper to rotate 90 degrees to the closed position. The flapper location can be downhole of seat 1 so that seat 1 can still be available as a backup, if the flapper fails to close. Body 5 and seat 4 can be one piece or more than one piece.

Remote actuation is alternatively envisioned with the use of electromagnetic pulses, pressure pulses, pressure or electromagnetic pulses generated from the firing of the gun, or using a passage 6 large enough to provide no significant resistance at 15 BPM or less for example and more significant resistance at higher flows to be used to trigger a timer for the release of the valve member 3.

The valve member 3 can comprise a seat assembly or it can be disintegrating or dissolvable.

Figure 2:
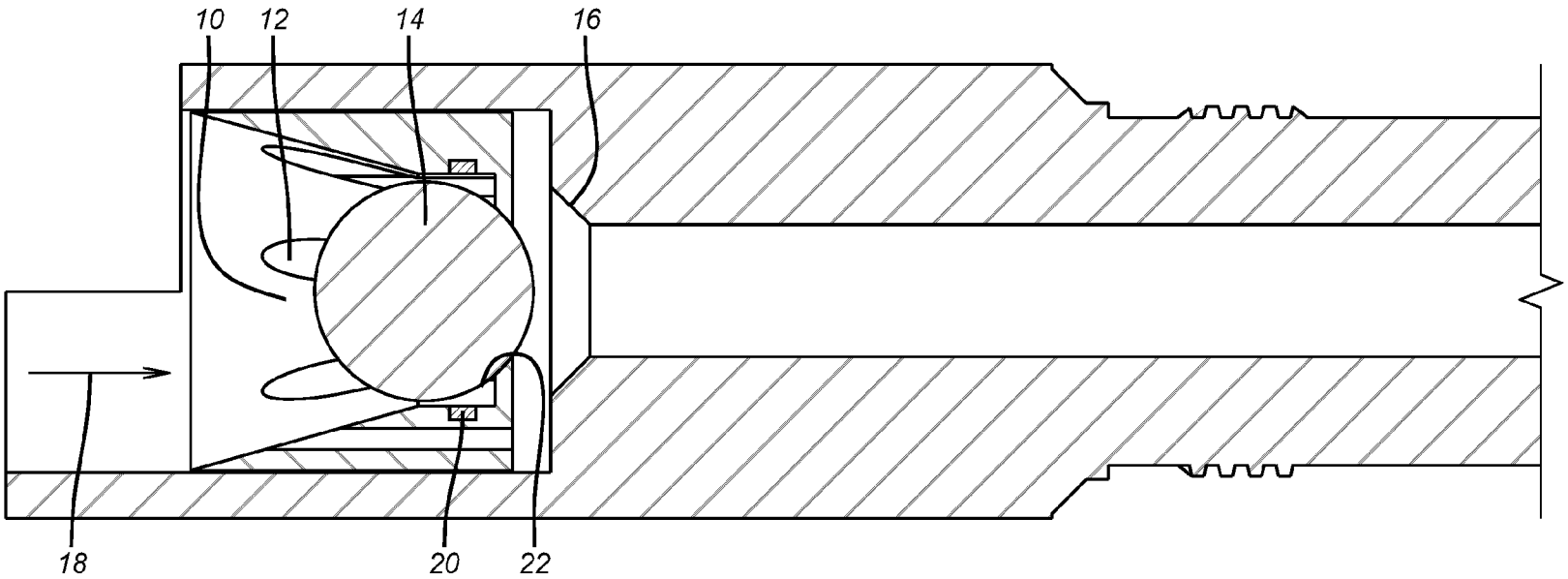
FIG. 2 shows a valve member retained by extending fingers.

FIG. 2 is an alternative embodiment using collet fingers 10 that have gaps 12 to retain an object such as a ball 14 away from a seat to allow flow under certain conditions before the fingers 10 no longer grip and the ball 14 lands on the seat 22. At that point flow in the direction of arrow 18 stops. The release of ball 14 can occur with increasing flow rate, thermal exposure, chemical attack or disintegration of the fingers 10 to name a few examples. Another option is to install a band 20 around fingers 10 that can hold support 22 in place until enough force is applied with flow, for example, to break the band 20 and release the ball 14 to land on seat 16.

Figure 3:
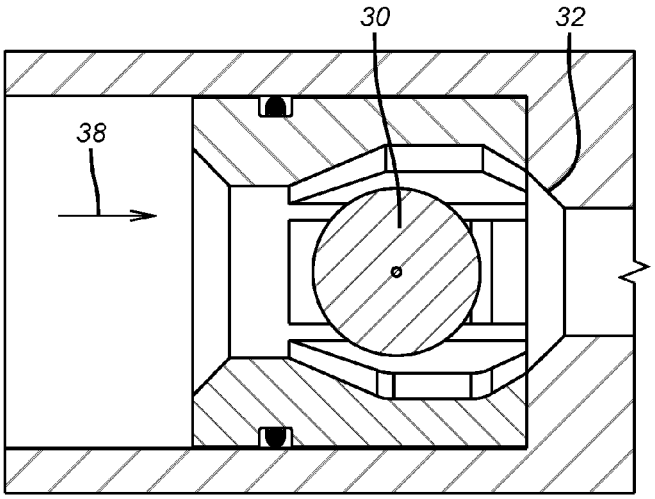
FIGS. 3-5 show views of a spherical valve member retained by a wire.
Figure 4:
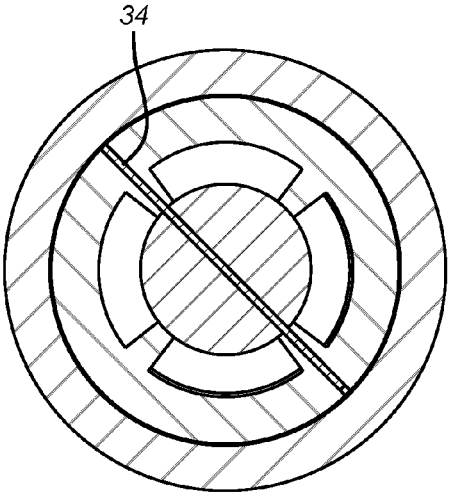
Figure 5:
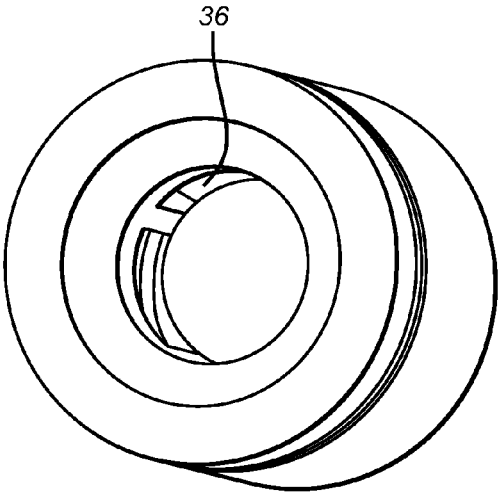

FIGS. 3-5 show different views of another embodiment where a ball or other object 30 is held away from a seat 32 by a wire 34 that can be copper or brass so that flow can pass through openings 36 bypassing ball 30 until the wire 34 fails from a variety of causes and advances onto seat 32 to shut off flow in the direction of arrow 38. Wire 34 can be failed by increasing flow as well as the other options listed for fingers 10 above.

Figure 6:
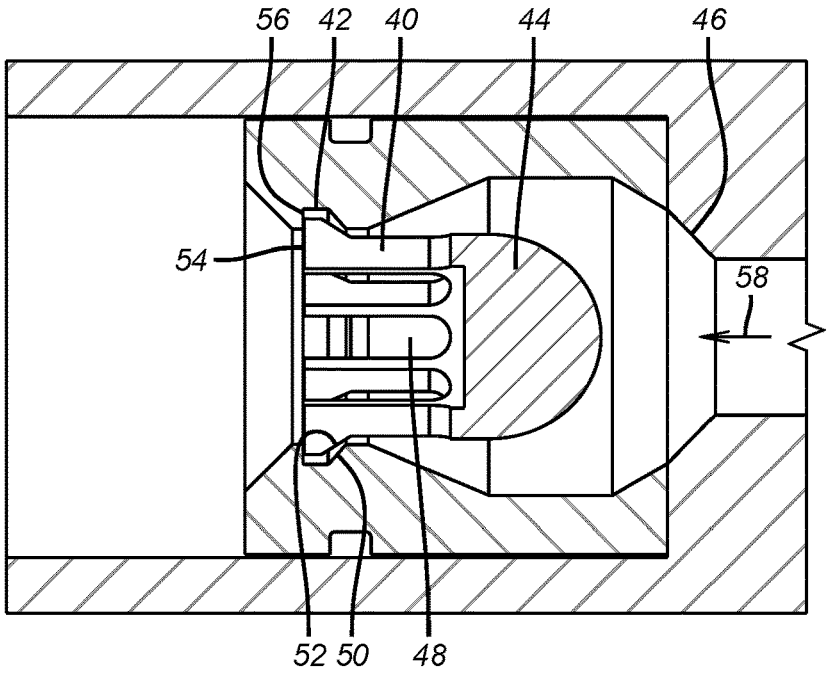
FIG. 6 shows a valve member retained by collet fingers.

FIG. 6 employs flexible collet fingers 40 retained in one or several grooves 42 that support a hemispherical leading end 44 that lands on the seat 46 after increased flow through gaps 48 between fingers 40 allows them to spring out of grooves 42. As mentioned before with regard to fingers 10 other mechanisms are envisioned for release that allows end 44 to land on the seat 46. Inclined surfaces 50 and 52 promote release on increasing flow while transversely oriented surfaces 54 and 56 resist movement in the uphole direction indicated by arrow 58.

Figure 7:
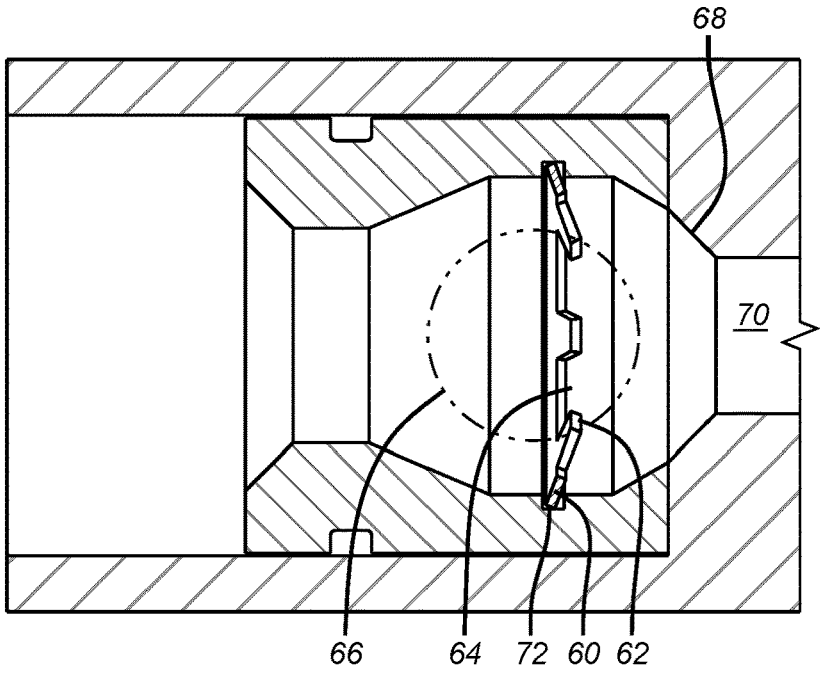
FIG. 7 shows a ball retained by a ring with extending fingers.

FIG. 7 illustrates a ring 60 with spaced extending fingers 62 that define gaps 64 in between. Ball 66 is retained on fingers 62 so that flow can go around the ball 66 through the gaps 64 until a predetermined flow rate is reached at which point the ball 66 pushes through the fingers 62 to land on the seat 68. While fingers 62 are shown oriented in a downhole direction they can also be oriented uphole or perpendicular to passage 70. The ring 60 can be complete or split as shown in the associated groove 72. If the ring is split the fingers 62 will move radially instead of or in addition to moving axially in a flexing motion. In another alternative the fingers can be eliminated when used with a gapped snap ring. The gap allows flow up to a predetermined value while excess flow simply expands the ring radially to let the ball pass. As another option the ball can be soft enough so that on flow buildup beyond a predetermined value, the ball 66 simply is forced through its support structure to land on the seat 68. The ball 66 can be trapped between fingers 62 and seat 68 after being forced past fingers 62.

Figure 9:
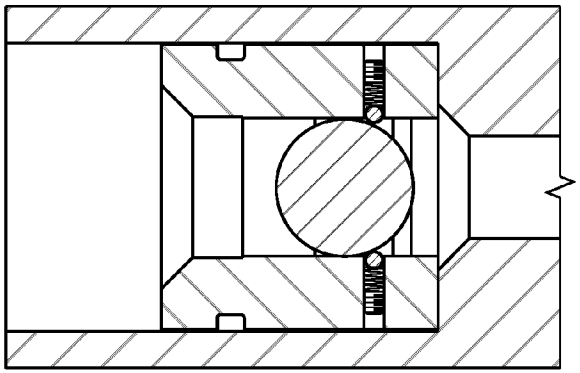
FIG. 9 shows a ball retained by a plurality of movable supports.
Figure 10:
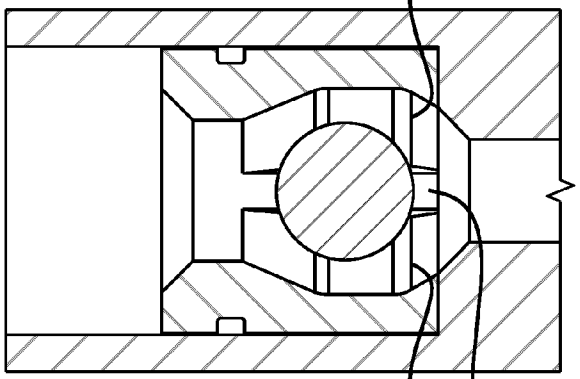
FIG. 10 is a rotated view of FIG. 8 showing the passages for flow between the fixed supports.
Figure 8:
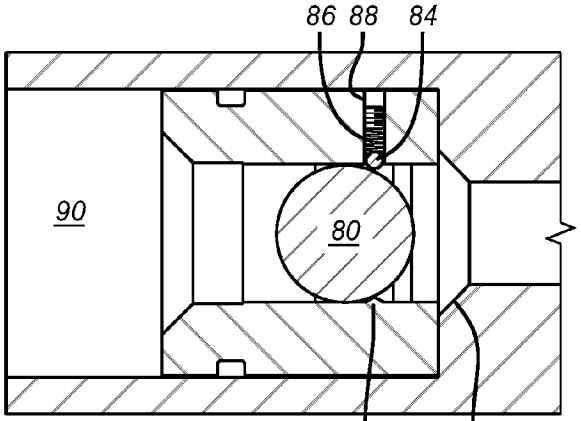
FIG. 8 shows a ball retained by a plurality of fixed supports and a movable support.

FIG. 8 shows a ball retained in part on one or more spaced ledges 82 that are fixed and a movable support such as a ball 84 biased by a spring 86 in a bore 88 transverse to passage 90. When a predetermined flow is reached the force on the ball 80 increases to the point of compressing spring 86 to retract ball 84 to allow ball 80 to pass to seat 92. Ball 84 can be retained against falling into passage 90 when in the extended position to support ball 80. In FIG. 9 the fixed support(s) is eliminated in favor of a second sprung ball assembly to the one shown in FIG. 8. FIG. 10 is a rotated view of FIG. 8 showing the spaced supports 82 that are fixed and flow passages 92 that exist in between the supports 82.

Those skilled in the art will appreciate that the various illustrated embodiments allow flow in a given direction through a plug passage and once closed by events in a passage therethrough stay closed to flow in the plug passage in the same direction. The housing for the valves remains intact and requires no physical separation to trigger valve member movement. Instead, valve movement occurs with increased flow or other means operative in the passage to release or remove the valve member.

Figure 11:
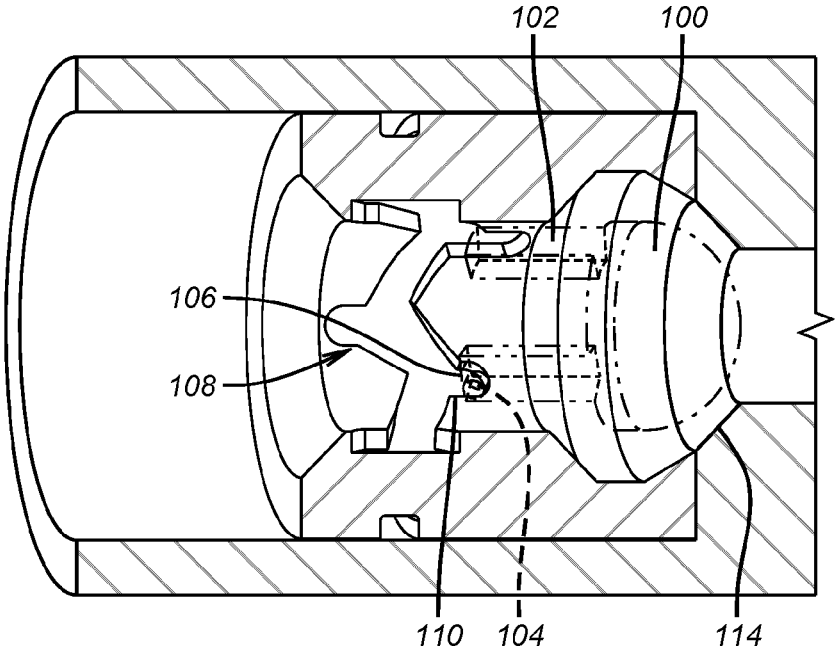
FIG. 11 shows a j-slot variation of the control for the valve member in the open position.
Figure 12:
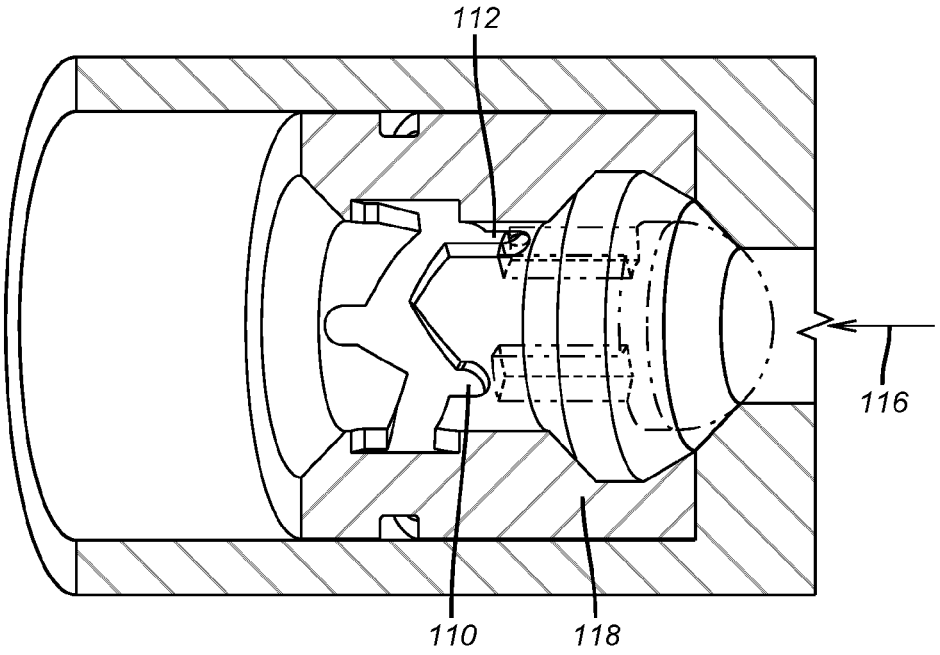
FIG. 12 is the view of FIG. 11 in the closed position for the valve member.

FIG. 11 shows a valve member 100 having spaced extending members 102 with a pin 104 in at least one end 106 of the extending members oriented to ride in j-slot 108. Longitudinal slot 110 is shorter than adjacent slot 112 so that in FIG. 11 the valve member is held off the seat to allow flow to pass between the extending members 102. In the FIG. 12 position the valve member 100 contacts the seat 114 due to the longer length of slot 112. A force in the direction of arrow 116 can come from formation flow or a spring or equivalent biasing device. The j-slot can have just two slots 110 and 112 to allow it to be run in open and then closed when needed so that valve member 100 stays on seat 114 once landing on it. The initial open position can be selectively locked to avoid early actuation to the closed position. The lock can be a breakable or disintegrating member that will resist forces that would otherwise advance the valve member 100 before it is put in the desired location. In a frack plug application there is no need to go from the FIG. 12 closed position back to the FIG. 11 open position. However, in other applications the j-slot assembly can be configured to allow multiple cycles of closing and then reopening if needed. The connection of the valve member 100 to the j-slot 108 can also help resist relative rotation especially when the j-slot is not continuous to facilitate milling out the valve assembly when used with an associated frack plug.

The above description is considered illustrative of the invention and those skilled in the art will appreciate that the claims below comprise the full scope of the invention.

We claim:

1. A valve for borehole use for selectively allowing flow in a predetermined direction and selectively closing off said flow, comprising:

a housing having a passage therethrough and a seat surrounding said passage in said housing;

a valve member at a spaced location from said seat selectively retained in a first position in said passage to permit a first predetermined passage flow to bypass said valve member and continue through said passage in the predetermined direction, said valve member selectively released from within said passage, using a second predetermined passage flow higher than said first predetermined passage flow bypassing said valve member, to contact said seat to close off flow in the predetermined direction where said valve member meets said seat and not reopen to flow in the predetermined direction.

2. The valve of claim 1, wherein:

said selective release occurs from a change in flow through said passage.

3. The valve of claim 2, wherein:

said change in flow comprises a flow increase.

4. The valve of claim 1, wherein:

said valve member selectively retained by a retainer that is selectively compromised with at least one or applied force, increasing passage flow rate, thermal exposure, chemical attack and disintegration of said retainer.

5. The valve of claim 4, wherein:

said retainer comprises at least one shear pin, a snap ring, or a c-ring.

6. The valve of claim 1, wherein:

said valve member is retained by at least one breakable retainer.

7. The valve of claim 6, wherein:

said retainer comprises a wire extending through said valve member.

8. The valve of claim 1, wherein:

said valve member is retained by at least one flexing retainer.

9. The valve of claim 8, wherein:

said retainer comprises a ring with spaced radially extending tabs to selectively retain said valve member away from said seat with flow bypassing said valve member between said tabs.

10. The valve of claim 9, wherein:

said tabs oriented transversely to said passage and flex axially to allow said valve member to engage said seat.

11. The valve of claim 9, wherein:

said ring is split to allow said tabs to move radially to release said valve member to engage said seat.

12. The valve of claim 8, wherein:

said flexing retainer comprises spaced collet fingers supported in at least one groove in said housing while permitting flow around said valve member through spaces between said collet fingers.

13. The valve of claim 8, wherein:

said flexing retainer comprises spaced collet fingers with a free end extending into said passage for selective retention of said valve member away from said seat while permitting flow between said fingers.

14. The valve of claim 13, wherein:

said collet fingers release said valve member with at least one of applied force, increasing passage flow rate, thermal exposure, chemical attack and disintegration.

15. The valve of claim 1, wherein:

said valve member is retained by at least one biased retainer.

16. The valve of claim 15, wherein:

said biased retainer comprises a ball and spring in a bore transverse to said passage to allow said ball to extend in part into said passage without leaving said bore and to be selectively pushed into said bore by said valve member to allow said valve member to reach said seat.

17. The valve of claim 15, wherein:

said valve member is retained in part by at least one fixed retainer which leaves at least one opening in said passage for flow around said valve member before said biased retainer is deflected.

18. A valve for borehole use for selectively allowing flow in a predetermined direction and selectively closing off said flow, comprising:

a housing having a passage therethrough and a seat surrounding said passage in said housing;

a valve member selectively retained in a first position in said passage to permit flow to bypass said valve member and continue through said passage in the predetermined direction, said valve member selectively released from within said passage to contact said seat to close off flow in the predetermined direction and not reopen to flow in the predetermined direction;

said valve member is retained by at least one breakable retainer;

said retainer comprises a wire extending through said valve member;

said valve member comprises a sphere.

19. The valve of claim 18, wherein:

said sphere is smaller than said passage such that flow can pass around said sphere when held away from said seat by said wire.

* * * * *